United States Patent [19]

Matsuo et al.

[11] 4,273,817

[45] Jun. 16, 1981

[54] HEAT-TRANSFERRABLE APPLIQUÉ

[76] Inventors: Mototsugu Matsuo, 4-36, Nishi 2-chome, Nakazaki, Kita-ku, Osaka-shi, Osaka-fu; Kazuo Otomine, 533, Sanjo-cho, Takamatsu-shi, Kagawa-ken, both of Japan

[21] Appl. No.: 53,201

[22] Filed: Jun. 29, 1979

[51] Int. Cl.[3] ..... B44C 3/02

[52] U.S. Cl. ..... 428/90; 156/72; 428/95; 428/349; 428/354; 428/355

[58] Field of Search ..... 428/85, 95, 90, 88, 428/349, 354, 355; 156/72

[56] References Cited

U.S. PATENT DOCUMENTS

| | | | |
|---|---|---|---|
| 3,379,604 | 4/1968 | Weber | 428/90 |
| 3,956,552 | 5/1976 | Geary | 428/95 |
| 4,142,929 | 3/1979 | Otomine | 428/88 |

*Primary Examiner*—Marion McCamish
*Attorney, Agent, or Firm*—Wenderoth, Lind & Ponack

[57] ABSTRACT

The invention relates to a transferrable applique wherein patterns, letters and the like are formed by temporarily bonding short fibers to the surface of a base sheet, such as paper and the like, the fibers being heat-transferred to an apparel, hat, bag and the like, more particularly the invention relates to a heat-transferrable applique having a dispersive dye layer of patterns, letters and the like, printed on the surface of a base sheet by use of dispersive dyes having relatively low sublimation fastness, on said layer there being provided a short fiber layer composed of short fibers made of material dyeable by sublimation of the dispersive dyes temporarily bonded by a porous temporary adhesive layer to the base, there being provided on said short fiber layer an adhesive layer with its position substantially conformed to that of the dispersive dye layer, the surface of said adhesive layer having a granulated or pulverized heat-sensitive adhesive layer, the short fibers being dyed by a preliminary heating of the dispersive dye layer and the heating at the time of transfer or by the sublimation through the heating at the time of transfer.

4 Claims, 7 Drawing Figures

HEAT-TRANSFERRABLE APPLIQUE

The invention relates to a heat-transferrable appliqué wherein patterns, letters and the like are formed by temporarily bonding short fibers to the surface of a base sheet, such as paper and the like, the short fibers being heat-transferred to an apparel, hat, bag and the like.

Generally, it is a commonly known art that patterns, letters and the like formed by temporarily bonding short fibers to the surface of a base sheet are transferred to an apparel or the like as an appliqué. Such appliqué has a solid beauty and a soft touch since it is composed a layered short fibers. In the conventional appliqué, however, dyed short fibers temporarily bonded to a base sheet were left as they stood, or the short fibers were screen-printed after they had been bonded to a base sheet. Thus, it was difficult to produce the effect of neutral tints on the patterns formed by the short fibers, and it was next to impossible to reproduce patterns having a complicated color arrangement. The conventional method had a further disadvantage in that printing was relatively indistinct since the patterns were printed, so to speak, from the rear side of the appliqué.

The invention has for an object to provide a heat-transferrable applique wherein short fibers are used as the transfer material and designs of beautiful colors are reproduced thereon.

Another object of the invention is to enable one to dye the layered short fibers with simplicity and distinctness.

A still further object of the invention is to make it possible to transfer the short fibers to an apparel and the like with simplicity and solidity.

The heat-transferrable appliqué according to the invention has a dispersive dye layer of patterns, letters and the like printed on a base sheet by use of dispersive dyes having a relatively low sublimation fastness, there being provided on said dispersive dye layer a short fiber layer wherein the short fibers are made of material dyeable by sublimation of dispersive dyes. The fibers are temporarily bonded by means of a porous temporary adhesive layer, there being provided on said short fiber layer an adhesive layer with its position substantially conformed to that of the dispersive dye layer, said adhesive layer having on its surface a granulated or pulverized heat-sensitive adhesive layer. The fibers of the short fiber layer are dyed by sublimating the dispersive dye layer by means of a preliminary heating and heating at the time of transfer or by means of heating at the time of transfer.

Preferred embodiments of the invention are shown in the accompanying drawings.

Figure 1A:
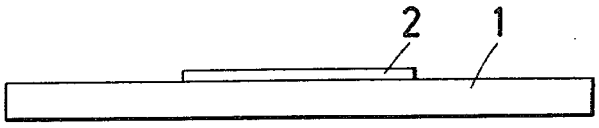
FIGS. 1A–1E are elevational views, on a magnified scale, showing the sequential stages of the process.
Figure 1B:
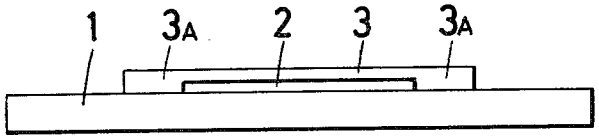
Figure 1C:
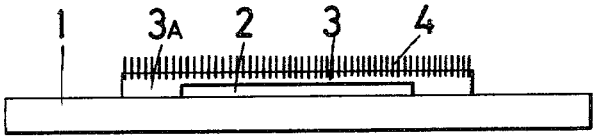
Figure 1D:
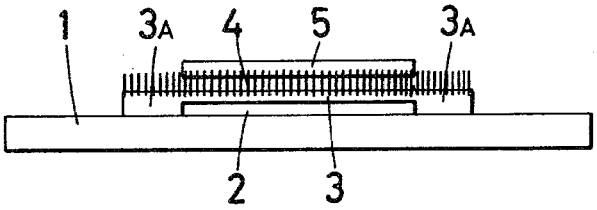
Figure 1E:
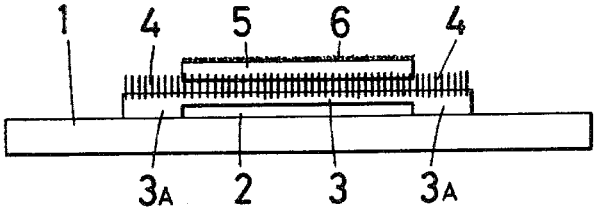

Referring to the drawings, the numeral 1 designates a base sheet which is not susceptible to a change of quality when heated at the time of transfer and capable of being printed beautifully with dispersive dyes with resistance to permeation of the printed dispersive dyes when sublimated. For example, art paper having a smooth surface is preferable. The numeral 2 designates a dispersive dye layer comprising patterns, letters and the like printed on the surface of the base sheet 1. Dispersive dyes having a relatively low sublimation fastness, for example, sublimation temperatures of 150°–250° C., are used. If the sublimation temperature is too high, it may deteriorate the base sheet 1 and the short fibers or melt the adhesive layer unnecessarily, while if the sublimation temperature is too low, there is a danger of the dispersive dyes, applied to the short fibers, smearing the apparel and the like during the transferring process. Therefore, such dyes having sublimation characteristics within said temperature range are suitable. The dispersive dyes are applied to the surface of the base sheet 1 by the gravure, offset or screen printing method.

Figure 2:
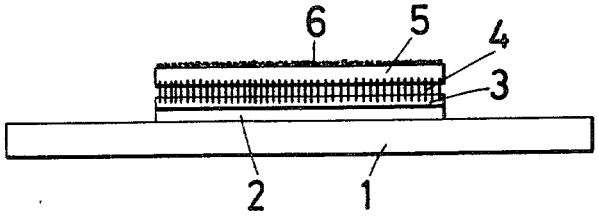
FIG. 2 is an elevational view, on a magnified scale, showing another embodiment.
Figure 3:
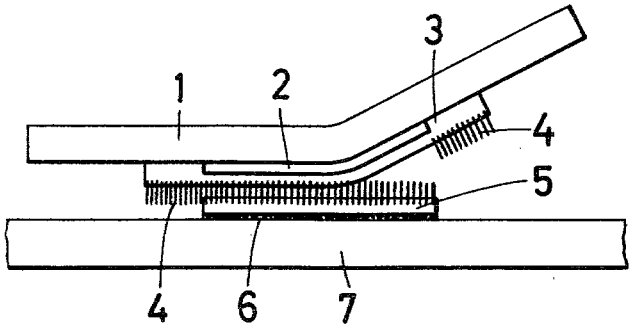
FIG. 3 is an elevational view, on a magnified scale, showing the state at the time of transfer.

The dispersive dye layer 2 has on its surface a porous temporary adhesive layer 3, to the whole surface thereof being temporarily bonded short fibers made of material dyeable with dispersive dyes so that a short fiber layer 4 is formed. In the drawings, though the short fibers are shown by parallel lines for simplification, they are in reality in the form of felt due to their high density. As shown in FIG. 1, if the temporary adhesive layer 3 is formed larger than the dispersive dye layer 2 by providing a part (3A) projecting beyond the periphery of the dispersive dye layer 2, the short fiber layer 4 also becomes larger than the dispersive dye layer 2. Thus, when the dispersive dye layer 2 is sublimated by heating, dispersive dyes which tend to sublimate outside the layer are absorbed by the projecting part (3A) of the short fiber layer 4 thereby preventing smearing of the apparel or the like during the heat-transferring process. Needless to mention, however, if the apparel or the like is made of material undyeable with dispersive dyes, the aforesaid consideration of smear prevention is unnecessary, and the temporary adhesive layer 3 may be provided in substantially the same shape and dimensions as those of the dispersive dye layer as shown in FIG. 2. The adhesive agent forming the temporary adhesive layer 3 should contain as small an amount of solid components as possible, such as resins and the like, so that the short fibers can be detached from the base sheet with simplicity while the adhesive is completely absorbed by the short fibers or the base sheet 1 when heated. It is preferable to use, for example, a liquefied or emulsified adhesive chiefly comprising one or more than two kinds of synthetic resins or copolymers thereof, such as polyvinyl acetate, polyvinyl alcohol, polyvinyl chloride, polyvinyl butyl alcohol, acrylic resin, polyurethane, polyester, polyamide, cellulose delivative, rubber delivative, casein, dextrine, gum arabic, carboxymethyl cellulose, rosin and the like, mixed with a lustering agent and a separating agent. The coating amount of the temporary adhesive layer 3 is preferably to such extent that the short fiber layer 4 can be readily detached from the base sheet at the time of the heat-transferring process. To mention an example, an amount of about 200 g/m$^2$ in wet state was sufficient to bond the short fibers and attain the object of the heat-transferring. The temporary adhesive layer 3 is porous so that it enables the sublimated dispersive dyes to pass therethrough. The porosity is obtainable, for example, by mixing sodium alginate with the adhesive.

The short fibers are made of material dyeable with dispersive dyes, for example, polyester, polyamide 66, triacetate, polyacrylic nitrile and the like. The length is about 0.5–0.3 mm. The short fibers are bonded to the temporary adhesive layer 3 in a layer with high density by means of electrostatic process, sprinkling, spraying, etc., before the adhesive is hardened. The short fibers are preferably, though not necessarily white, since they are dyed by dispersive dyes after bonding.

On the surface of the short fiber layer 4 is provided an adhesive layer 5 capable of rigidly bonding the short fibers with its position substantially conformed with that of the dispersive dye layer 2, and in the same shape and size as those of the dispersive dye layer 2 or relatively smaller than that, a pulverized or granulated heat-sensitive adhesive layer 6 being provided on the surface of the adhesive layer 5. For the adhesive layer 5 there is preferably employed a liquefied or emulsified adhesive agent chiefly comprising acrylic resin, polyvinyl chloride, polyvinyl acetate, polyurethane, polyester, etc., said adhesive being suitable for soft apparels or the like since it retains elasticity even after it is hardened. The adhesive layer 5 can be registered with the dispersive dye layer 2 with simplicity if it is formed by means of the screen or gravure printing method. The heat-sensitive adhesive layer 6 is formed by applying, before the adhesive layer 5 is hardened, a pulverized or granulated adhesive chiefly comprising one or more than two kinds of a polyvinyl chloride, thermoplastic acrylic resin, a polyethrene, a polyamide, polyester, paraffin, a rubber delivative, etc.

The appliqué constructed as described hereinbefore is heated to sublimate the dye in the dispersive dye layer 2 thereby enabling the short fibers bonded to the temporary adhesive layer 3 to be dyed into patterns, letters and the like of the same color and configuration as those of the dispersive dye layer 2. The heating is effected, after the heat-sensitive adhesive layer has been formed, at a temperature conformable to the dispersive dyes to be used for sublimation dyeing. Re-heating may be effected at the time of transfer. To be more precise, it is preferable to effect preliminary heating when the sublimation temperature of the dispersive dyes is high and the heating at the time of transfer alone is not sufficient. Though the dispersive dye layer 2 is covered by the temporary adhesive layer 3, the short fiber layer 4 can be dyed with reliability without impediment to the sublimation characteristics thereof since the temporary adhesive layer 3 is porous.

The appliqué according to the invention is transferrable to an apparel or the like as follows. The coated surface of the heat-sensitive adhesive layer 6 is brought into contact with the subject to be transferred 7, that is, an apparel or the like, and then pressure and heat are applied to the base sheet by means of a heated metal plate or the like. Then, the heat-sensitive adhesive layer 6 is softened and rigidly bonded to the subject to be transferred 7. When the base sheet is detached from the subject to be transferred 7, the short fiber layer 4 bonded to the adhesive layer alone is separated from the base sheet, since the adhesive layer 5 has a greater adhesion than that of the temporary adhesive layer 3, thereby making it possible to transfer the appliqué of the same configuration and colors as that of the dispersive dye layer 2. The short fiber layer 4 is dyed also during this heat-transferring process.

The transferrable appliqué according to the invention comprises a base sheet 1 on which is formed a dispersive dye layer by printing, a short fiber layer 4 bonded thereto with the interposition of a temporary adhesive layer 3, said short fiber layer being dyed by the sublimation of a dispersive dye layer 2. The dispersive dye layer 2 can be printed by a gravure, offset or screen printing method in an optional combination of beautiful colors. Thus, the short fiber layer 4 dyed in bright colors can be transferred as a beautiful applique. Since the dispersive dye layer 2 is provided on the base sheet 1, the dyeing of the short fiber layer 4 by the sublimation thereof is effected on the surface of the short fiber layer 4 when transferred thereby enabling to obtain a very distinct dyeing effect. The heat-sensitive adhesive layer 6 softened by the heat at the time of transfer adheres to the subject to be transferred 7. However, the softened heat-sensitive adhesive layer 6 is prevented from adhering to the short fiber layer 4 since the adhesive layer 5 is interposed between the heat-sensitive adhesive layer 6 and the short fiber layer 4. Thus, the short fiber layer 4 can be rigidly bonded to the subject to be transferred 7 as an appliqué. The heat-sensitive adhesive layer 6 is formed by bonding a granulated or pulverized adhesive to the adhesive layer 5 so that it may have a rough surface. Thus, the transfer can be effected with simplicity and reliability onto the slippery surface of textile fabric of the subject to be transferred 7. Moreover, the projections on the surface of the heat-sensitive adhesive layer 6 easily fit into the recesses of the surface of the textile fabric thereby enabling to obtain adhesion with greater rigidity.

The temporary adhesive layer 3 may be provided with a part (3A) projecting outwardly beyond the dispersive dye layer 2. Then, when the dispersive dyes are sublimated by the transferring heat, the dyes behaving on the peripheral part are absorbed by said projecting part (aA) thereby enabling to increase the operational efficiency without the risk of the subject to be transferred being smeared. Furthermore, if the adhesive layer 5 is composed of an adhesive capable of retaining elasticity after hardening, there is no risk of the transferred appliqué being exfoliated as a result of extension and contraction of the subject to be transferred 7, that is, an apparel or the like, since it is deformed in all directions while it is worn. Moreover, this elasticity of the adhesive helps to improve the soft touch of the transferred appliqué.

The appliqué according to the invention is producible by forming all the dispersive dye layer 2, the temporary adhesive layer 3 and the adhesive layer 5 by means of printing, thereby enabling to obtain an appliqué having a complicated pattern with simplicity and high efficiency.

What is claimed is:

1. A heat-transferrable appliqué comprising a base sheet; a sublimable dye layer on the surface of the base, which layer is formed by printing sublimable dyes of relatively low sublimation fastness on the base sheet; a short fiber layer temporarily bonded to the sublimable dye layer by means of a porous temporary adhesive layer, said adhesive layer having such porosity as to enable the sublimable dye to pass therethrough upon sublimation, said short fiber layer being dyable by sublimation of the sublimable dyes by application of heat; an adhesive layer located on the short fiber layer with its position substantially conforming to that of the sublimable dye layer, said adhesive layer having on its surface a granulated or pulverized heat-sensitive layer, wherein said short layer being dyed by the sublimation of the sublimable dye layer upon the application of heat.

2. A heat-transferrable appliqué as defined in claim 1 wherein the temporary adhesive layer is adapted to project outwardly beyond the periphery of the sublimable dye layer, the short fiber layer being adapted to project beyond the periphery of the sublimable dye layer.

3. A heat-transferrable appliqué as defined in claims 1 or 2 wherein the adhesive layer is formed by an adhesive agent capable of retaining elasticity after it is hardened.

4. A heat-transferrable appliqué as defined in claim 1 wherein the sublimation temperature of the sublimable dyes in the dye layer is between 150° to 250° C. and the base sheet is art paper having a smooth surface.

* * * * *